US008316606B2

(12) United States Patent
Siewert et al.

(10) Patent No.: US 8,316,606 B2
(45) Date of Patent: Nov. 27, 2012

(54) FASTENING SYSTEM FOR PANELS AND TRIM

(75) Inventors: Rick W. Siewert, Minneapolis, MN (US); Mark A. Gilbertson, Arden Hills, MN (US)

(73) Assignee: Siewert Cabinet & Fixture Manufacturing, Inc., Minneapolis, MN (US)

( * ) Notice: Subject to any disclaimer, the term of this patent is extended or adjusted under 35 U.S.C. 154(b) by 1310 days.

(21) Appl. No.: 11/423,144

(22) Filed: Jun. 8, 2006

(65) Prior Publication Data

US 2007/0283658 A1 Dec. 13, 2007

(51) Int. Cl.
*E04F 13/00* (2006.01)

(52) U.S. Cl. ..... 52/483.1; 52/592.1; 52/592.4; 52/718.03

(58) Field of Classification Search ..... 52/481.1, 52/483.1, 592.1, 592.4, 718.03, 591.3, 592.2, 52/177

See application file for complete search history.

(56) References Cited

U.S. PATENT DOCUMENTS

| | | | | | |
|---|---|---|---|---|---|
| 357,144 | A | * | 2/1887 | Buttler | 52/592.2 |
| 470,377 | A | * | 3/1892 | Graham | 52/592.1 |
| 1,983,040 | A | * | 12/1934 | Lyons | 52/592.1 |
| 2,243,161 | A | * | 5/1941 | Lahti | 52/592.1 |
| 2,302,962 | A | * | 11/1942 | Laucks et al. | 52/481.1 |
| 3,214,878 | A | * | 11/1965 | Hartman et al. | 52/718.03 |
| 3,909,996 | A | * | 10/1975 | Ettlinger et al. | 52/177 |
| 4,580,385 | A | | 4/1986 | Field | |
| 4,606,161 | A | | 8/1986 | Hosoe | |
| 5,136,823 | A | * | 8/1992 | Pellegrino | 52/592.1 |
| 5,165,213 | A | | 11/1992 | Finch et al. | |
| 5,259,164 | A | | 11/1993 | Wiese | |
| 5,493,832 | A | | 2/1996 | Abrams | |
| 5,561,960 | A | | 10/1996 | Minnick et al. | |
| 5,715,641 | A | | 2/1998 | Hall, Jr. | |
| 5,778,618 | A | | 7/1998 | Abrams | |
| 6,009,679 | A | | 1/2000 | Larsen | |
| 6,378,258 | B1 | * | 4/2002 | Cunningham et al. | 52/404.1 |
| 6,588,166 | B2 | | 7/2003 | Martensson et al. | |
| 6,606,834 | B2 | | 8/2003 | Martensson et al. | |
| 6,751,912 | B2 | * | 6/2004 | Stegner et al. | 52/177 |
| 6,802,168 | B1 | | 10/2004 | Minnick | |
| 6,810,834 | B2 | * | 11/2004 | Hutchings et al. | 52/177 |
| 7,516,587 | B2 | * | 4/2009 | Barlow | 52/177 |
| 7,721,506 | B2 | * | 5/2010 | Bennett et al. | 52/789.1 |
| 2002/0095902 | A1 | | 7/2002 | Miller et al. | |
| 2003/0150186 | A1 | | 8/2003 | Spransy | |
| 2004/0055242 | A1 | | 3/2004 | Iwakawa et al. | |
| 2005/0028475 | A1 | * | 2/2005 | Barlow et al. | 52/578 |

* cited by examiner

*Primary Examiner* — William Gilbert
*Assistant Examiner* — Matthew J Smith
(74) *Attorney, Agent, or Firm* — Kramm Law; John Kramm

(57) ABSTRACT

A fastening system for panels and trim having a fastening element including a reveal edge and a serpentine edge. A projection and a recess is disposed adjacent to each other on the same serpentine edge. The fastening element guides and connects adjacent panel faces into a flush horizontal alignment with each other. Panels with the fastening element on each side may be combined together in a multiple course structure. The fastening element accommodates dimensional changes in adjacent wood panels from moisture and temperature fluctuations by allowing for expansion both with the elimination of the gap in the serpentine edge expansion area and with the compression of the expansion relief aperture adjacent to the expansion bulge in the recess of the adjacent panel. An expansion relief aperture on the projection of a fastening element can receive a trim fastener for applying perimeter trim with a hidden fastener onto many structurally different panel designs.

13 Claims, 6 Drawing Sheets

FASTENING SYSTEM FOR PANELS AND TRIM

BACKGROUND

This invention relates to paneling, specifically to an improved wood panel attachment and alignment system for interrelating adjacent wood panels.

A problem addressed by this invention arises from attaching and aligning paneling. Unresolved problems with some currently known solutions call for creating new ways of mounting panels to a wall surface and to trim the panel edges. A new system is needed for working with different panel versions that also accommodates different panel sizes and termination conditions. The perimeter of the panels needs a new trim element to protect the sometimes vulnerable edges of panels and to visually frame them. Panels could be expected to cover some wall surfaces and structures that would span multiple panels in multiple courses. Another consideration early in the process was the desire to avoid visible fasteners when attaching the panels to the wall surface.

In addition to those problems presented when hanging wood panels, there is also a dimensional change problem. Wood is a hygroscopic material that in high humidity picks up moisture and swells while in low humidity releases moisture and shrinks. Uncontrolled extremes of relative humidity, whether low or high, are likely to cause problems. While a user can clearly see the damaged wood paneling from subsequent dimensional change in wood, the responsibility for preventing and correcting the problem is not clear. The manufacturer of the wood paneling may deny responsibility pointing to the inherent natural property of wood to change dimensions. Other times it can be unclear whether or not the cause and responsibility for dimensional change problems in wood products was the result of improper design and whether it is the responsibility of the designer or architect or specifier. Also, the question of cause and responsibility for dimensional change problems in wood products resulting from improper relative humidity exposure during site storage and installation may not end with the general contractor. Responsibility for dimensional change problems in wood products resulting from humidity extremes after occupancy may also rest with building engineering and maintenance. AWI AWMAC WI, Architectural Woodwork Standards §2, at 44 (1st ed. 2009). What is needed is to further address the subsequent dimensional change in wood panels.

A variety of panel hanging systems have been known in the art for quite some time. For example, a panel may simply be attached using nails or screws through the face of the finished wall panel into the wall framing or into blocking installed specifically for this purpose.

Another example is an interlocking extruded aluminum wall cleat system. Cleats fastened to the back of the wall panel engage cleats fastened through the wall surface into the wall framing or into blocking installed specifically for this purpose. The cleats are typically constructed of extruded aluminum. Blocking is typically installed by others. Shims are installed behind wall-mounted members. An instrument is required for proper field layout to level and to plumb panels. The number and placement of cleats must be determined in consultation with an installation team. AWI AWMAC WI, Architectural Woodwork Standards 626 (1st ed. 2009).

These and various other options for attaching the panels to the wall were considered but were eventually found wanting. Screwing or nailing through the face of the panel were options that were rejected immediately. Using an extruded aluminum "Z-clip" is an option common in the industry and was evaluated for this purpose. However it can require careful alignment of the two mating clips when installing as well as an added expense to purchase the hardware. It needs to be attached to the back of the panel with screws, and so sculpted panels that vary in thickness present the possibility that these screws could penetrate through the face of the paneling. Using thicker panels was considered but rejected due to some of the disadvantages of that option including higher costs for materials and shipping, greater weight to support on the wall and greater difficulty in handling through the manufacturing and installation processes.

A related technique is the use of "French cleats", typically two wood strips with mating beveled edges. An advantage that this has over the use of Z-clips is that it can be glued to the back of the panel eliminating the screw-through disadvantage. Unfortunately, additional material and labor to produce it are required. Still another disadvantage with both of these options, Z-clips and "French cleats" is that the panel must be spaced off of the surface of the wall by their inherent thickness, and therefore require deeper trim elements at exposed panel edges in order to hide their use.

These currently known indirect application methods and devices suffer from several unacceptable disadvantages for these presented problems and call for creating a new solution. Additional hardware or mounting blocking must be purchased or manufactured. Too much time is spent laying out the installation. The entire assembly extends too far from the wall requiring large edge trim elements.

How to join and trim custom wood panels pose additional challenges. Trim around the perimeter of the panels was explored in many ways. Some currently known examples include a lock miter outside corner, a splined miter outside corner, a solid wood outside corner, a solid wood reveal outside corner, a solid wood reveal inside corner, and a cut-to-fit inside corner. Additional joint and plant assembled joinery issues arise from joinery standards in the absence of specifications. Tightness of plant assembled joints between laminated components must address maximum gap and flushness variation factors. AWI AWMAC WI, Architectural Woodwork Standard 179-181, 547 (1st ed. 2009).

Prefabricated aluminum extrusions to be used as trim elements were considered at length. Many of these come with concealed mounting strips, which satisfy the hidden fastener requirement. The availability of multiple shapes of extrusion fit in well with the variety of panel patterns and finishes giving lots of design options. The options explored for installation of these extrusions were varied as well. One method was to attach the trim to the panel prior to mounting. Another method involved attaching the trim to the wall first creating a frame into which the paneling would be hung. Another method would be to hang the paneling first and then mount the trim to the wall around the paneling. While these extrusions were attractive and available in multiple finishes there was a desire to match the panel's finish exactly and to be able to create custom profiles for the trim. This concept led to experimenting with painted wood for the trim elements. Very early on the use of an off-the-shelf blind fastener such as a "Klick" fastener manufactured by Friedrich Knapp Gmbh in Austria having U.S. Pat. No. 6,186,698 was experimented with as a means of blind fastening the trim. The dovetail-shaped groove into which this fastener clips is easy to machine into the mating components and the relationship between panel and trim is consistently controlled by this pre-machined relationship. Combining this method of trim attachment with the rabbeted edge of the panel for screw attachment proved to be a harmonious solution to both issues.

Envisioning this treatment around the perimeter of each panel raised an issue of how to treat the joint between adjacent panels. Initially several versions of an intermediate trim element were explored. Again, this trim could be attached using the Klick fastener, thus hiding the attachment screws between panels. The need to allow the panels to expand and contract at this joint complicated this concept. The trim could not be allowed to attach to both of the adjacent panels without allowing movement. This led to experiments involving the machining of a slot very close to the panel's edge that could deform and absorb the expansion of the adjacent panel. Contraction of adjacent panels would simply pull them away from each other, the gap being covered by the intermediate trim element. An inherent advantage to this idea is that the panels would be installed tight to each other without the need for the installer to set the expansion gap. Several iterations of this expansion-absorbing slot were worked out. It was during this process that the idea was put forward of using the slot for the Klick fastener to also serve as the expansion-absorbing slot.

Also at this time the idea of one panel overlaying its neighboring panel came into play. If the first panel could be screwed on, then a portion of the second panel slipped beneath the first one's edge, then there would be no need for screws in that edge of the second panel. This was the genesis of the "projection & recess" concept.

Further experimentation with this concept led to the alternating use of projections and recesses to mutually engage both adjacent panels. This type of symmetry meant that the paneling could be installed the same way starting from either the left or right end of a run of paneling. This affords flexibility to the installer, which he might not otherwise have. This also allowed the panel to be universal in fit when rotated 180 degrees. Assuming the sculptural pattern on the panel's face was similarly symmetrical, this meant that there need not be a defined top or bottom to each panel.

Next to be refined was the shape of the serpentine edge of the recesses milled into the back of the panel. A bulge was introduced to bear against the web formed by the expansion relief slot of the adjacent panel. The bulge serves to index the panels' relationship when installed. When a panel needs to expand, this bulge deforms the web allowing the panel to expand without buckling.

This concept of interlaced projections and recesses eliminated the need for the intermediate trim to cover the joint. This has the advantage of allowing the pattern on the faces of adjacent panels to flow across the joint uninterrupted. The edge design in its final form can be machined on all edges if the paneling needs to be multiple courses tall. Otherwise it can be machined on only the vertical edges if that suits the application best. The projection serves double duty as a screw-mounting protrusion and as a surface area to mount perimeter trim using the Klick fasteners. Perimeter edges need not be machined any differently than meeting edges.

DESCRIPTION OF THE DRAWINGS

This brief description of several views of the drawings and the detailed description of the invention refer to different views for specifying the figure numbers and reference numerals to the different parts.

DETAILED DESCRIPTION OF THE INVENTION

Figure 1:
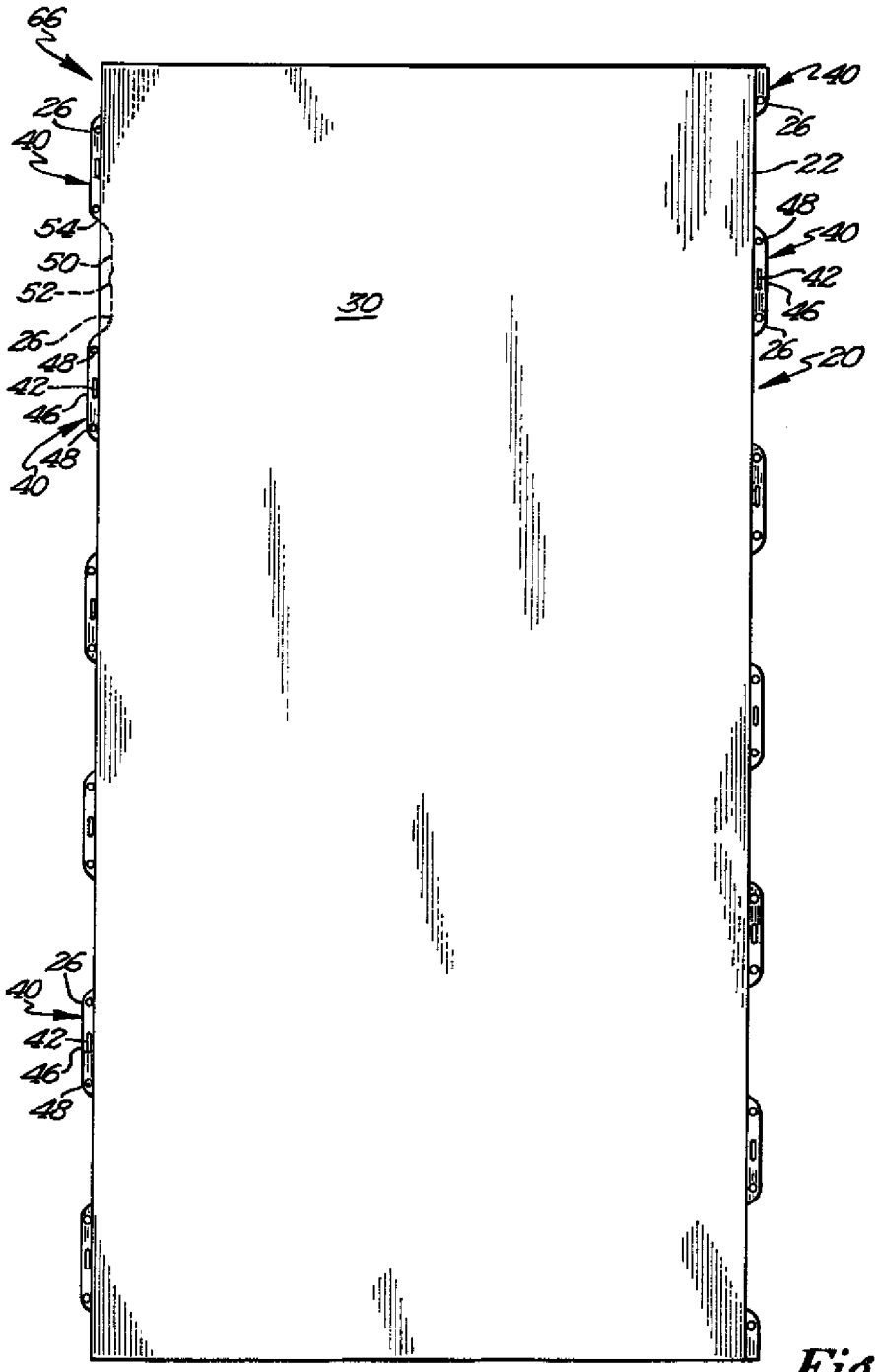
FIG. 1 is a front elevational view of a preferred embodiment of the invention as it is used to operatively connect panels together into a substantially fixed relation structure.

This disclosure describes the invention and the manner and process of making and using it to enable any person skilled in the pertinent or most nearly connected technological area of the invention to make and use it. The specific physical embodiments herein disclosed merely exemplify the invention which may be embodied in other specific structures. While the preferred embodiment has been described, the details may be changed without departing from the invention as defined by the claims.

The construction module comprises a modular unit having a side, a first face, and a second face. The modular unit has a configuration on one side shaped for connecting with the mating configuration of an opposed adjacent construction module on a substrate. In one example, the construction module such as fastening element 20 comprises a modular unit such as body 22 having a side, a first face such as panel front face 30, and a second face such as panel back face 32.

The side of the modular unit comprises a reveal portion, the reveal portion extending from the first face toward the second face, the reveal portion being shaped with at least a substantially flat plane along the longitudinal extent of the side of the modular unit for aligning with the reveal portion of the adjacent construction module. An example of a reveal portion is shown as reveal edge 24.

The side of the modular unit further comprises a serpentine portion. The serpentine portion extends from the second face toward the first face, the serpentine portion being shaped with at least a substantially inclined plane relative to the reveal portion along the longitudinal extent of the side of the modular unit, the serpentine portion being coextensively collocated with at least a section of the reveal portion on the same side of the modular unit for aligning with the serpentine portion of the adjacent construction module. An example of a serpentine portion is shown as serpentine edge 26.

The serpentine portion comprises a projection, the projection extending from the modular unit in a generally outwardly direction relative to the modular unit. The projection of the modular unit of the construction module extends substantially the same distance from the reveal portion of the modular unit of the construction module in a generally outwardly direction relative to the modular unit as the recess extends from the reveal portion of the modular unit in a generally inwardly direction relative to the modular unit. One example of such a projection is the projection 40.

The projection defines an aperture. For an example of such an aperture see FIGS. 8*a*, 8*b*, 9, 10, 11, and 12 showing the expansion relief aperture 42. The aperture is disposed away from the serpentine portion of the projection, with the aperture extending in a generally parallel direction relative to the serpentine portion of the projection, with the aperture configured for receiving a trim fastener, and with the aperture disposed at a predetermined distance away from the serpentine portion of the projection for dissipating an expansion force from an adjacent module so that when slidably coupling the construction module in a first direction toward mating with the opposed adjacent construction module, if the construction module is misaligned with the opposed adjacent construction module in a second direction, then some of the projection of the serpentine portion of the construction module may be obstructed by some of either the reveal portion or the projection of the serpentine portion of the opposed adjacent construction module and thereby producing a visually obvious gap at the joint to immediately alert the installer for timely correction before securing. But if the construction module is aligned with the adjacent construction module, then all of the projection of the serpentine portion of the construction module will fit with the serpentine portion of the adjacent construction module thereby producing no visually obvious gap at the joint to immediately confirm proper alignment and readiness for securing.

Figure 8:
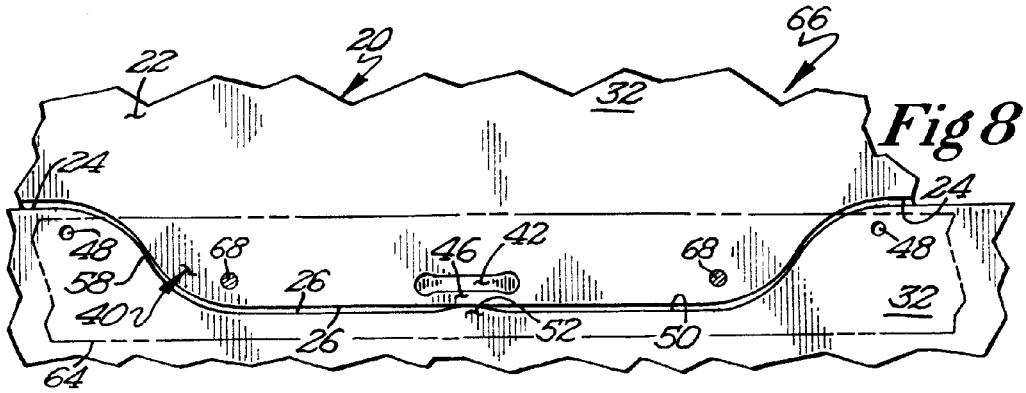
FIG. 8 is a rear elevational view of two mounted panels with a 2×4" stud in phantom and showing various mounting details including the serpentine edge expansion and the expansion relief aperture in a relaxed position.
Figure 8A:
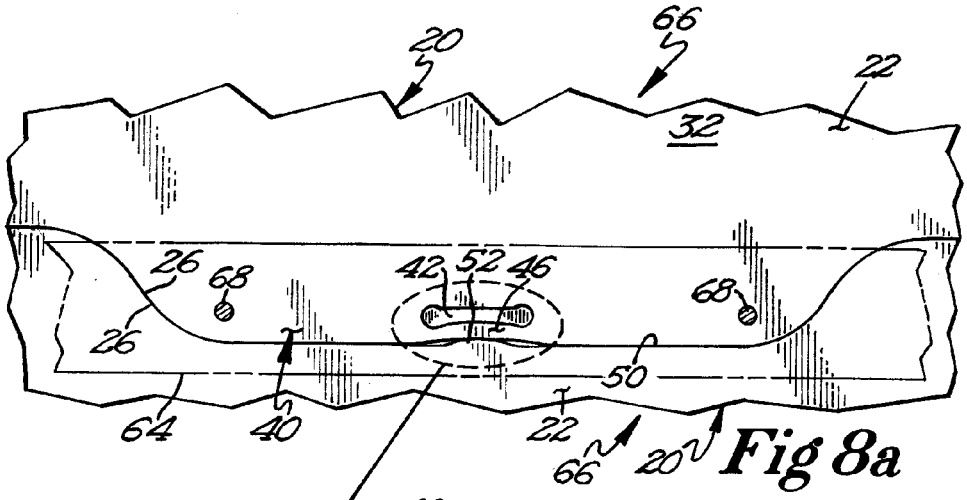
FIG. 8*a* is the same as FIG. 8 but in a compressed position showing how the invention accommodates dimensional changes in adjacent wood panels from moisture and temperature fluctuations by allowing for expansion both with the elimination of the gap in the serpentine edge expansion area and with the compression of the expansion relief aperture adjacent to the expansion bulge in the recess of the adjacent panel.
Figure 8B:
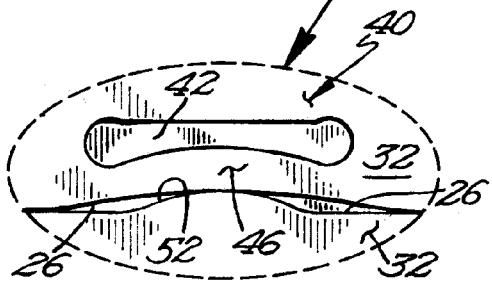
FIG. 8*b* is an enlarged section taken from FIG. 8*a* showing in more detail character references 42, 46, and 52.

The construction module defines an expansion bulge. The expansion bulge is disposed upon the serpentine portion of the receiving recess, with the bulge extending in a generally outwardly direction relative to the construction module, with the bulge configured for transferring an expansion force from the construction module to aperture of the projection of an adjacent module. One example of an expansion bulge is illustrated in FIGS. 8*a* and 8*b* as the expansion bulge 52.

In another embodiment of the invention the construction module comprises a modular unit having a side, a first face, and a second face, the modular unit having a configuration on one side shaped for integrally connecting with the mating configuration of an opposed adjacent construction module on a substrate.

The side of the modular unit comprises a reveal portion, the reveal portion extending from the first face toward the second face, the reveal portion being shaped with at least a substantially flat plane along the longitudinal extent of the side of the modular unit for aligning with the reveal portion of the adjacent construction module.

The side of the modular unit further comprises a serpentine portion. The serpentine portion extends from the second face toward the first face, the serpentine portion being shaped with at least a substantially inclined plane relative to the reveal portion along the longitudinal extent of the side of the modular unit, the serpentine portion being coextensively collocated with at least a section of the reveal portion on the same side of the modular unit for aligning with the serpentine portion of the adjacent construction module.

The serpentine portion comprises a first projection. The first projection extends from the modular unit in a generally outwardly direction relative to the modular unit, the first projection of the modular unit of the construction module extending substantially the same distance from the reveal portion of the modular unit of the construction module in a generally outwardly direction relative to the modular unit as the recess extending from the reveal portion of the modular unit in a generally inwardly direction relative to the modular unit to eliminate the need for interposing a spacing device between construction modules. The first projection of the modular unit of the construction module defines an aperture, with the aperture extending in a generally parallel direction relative to the serpentine portion of the first projection, with the aperture disposed at a predetermined distance away from the serpentine portion of the first projection, and with the aperture configured for deflecting and rebounding with expansion force changes from the opposed adjacent construction module.

The modular unit of the construction module defines a complementary shaped projection receiving recess. The receiving recess extends from the modular unit in a generally inwardly direction relative to the modular unit, the receiving recess being of proper size, shape and orientation to facilitate positioning of and at least substantially filling by the projection of the opposed adjacent construction module extending from the opposed adjacent construction module in a generally outwardly direction relative to the opposed adjacent construction module. The receiving recess and the first projection are disposed adjacent to each other on the same serpentine portion for restricting movement in a first direction. A complementary shaped projection receiving recess example is illustrated in FIGS. 2, 8, 9, and 11 as the complementary shaped projection receiving recess 50.

The side of the modular unit of the construction module that comprises the reveal portion and the serpentine portion is machined entirely within the thickness of the modular unit of the construction module for reducing the cost and work of attaching to the construction module a panel alignment hardware and for reducing some distance that a construction module must extend from a support surface caused by the use of a panel attachment bracket.

The serpentine portion of the side of the modular unit further comprises a second projection, the second projection extending from the modular unit in a generally outwardly direction relative to the modular unit. The second projection extends substantially the same distance from the reveal portion of the modular unit of the construction module in a generally outwardly direction relative to the modular unit as the recess extends from the reveal portion of the modular unit in a generally inwardly direction relative to the modular unit. The second projection is disposed adjacent to the receiving recess. Also the second projection, the receiving recess, and the first projection are disposed on the same serpentine portion for restricting movement in a second direction to transfer an expansion force from the construction module onto a web that deflects into an aperture defined by the projection of the opposed adjacent construction module with both the web and the aperture being on the same projection of the serpentine portion of the modular unit of the opposed adjacent construction module.

Another benefit of the invention provided is that when slidably coupling the construction module in a first direction toward mating with the adjacent construction module, if the construction module is misaligned with the adjacent construction module in a second direction, then some of the first projection or the second projection of the serpentine portion of the construction module may be obstructed by some of either the reveal portion or the projection of the serpentine portion of the adjacent construction module and thereby producing a visually obvious gap at the joint to immediately alert the installer for timely correction before securing. But if the construction module is aligned with the adjacent construction module, then all of the first and second projections of the serpentine portion of the construction module will fit with the serpentine portion of the adjacent construction module thereby producing no visually obvious gap at the joint to immediately confirm proper alignment and readiness for securing.

In one species of the invention, the reveal portion of the modular unit of the construction module has a substantially straight edge and the serpentine portion of the modular unit of the construction module has a plurality of substantially curved edges so that when the opposed adjacent construction module is pushed against the construction module, the first projection of the modular unit of the construction module and the opposed adjacent projection of the modular unit of the construction module slidably directs the projection of the opposed adjacent construction module into the receiving recess of the modular unit of the construction module for aligning in 3 directions the construction module with the opposed adjacent construction module.

In another species of the invention, the reveal portion of the modular unit of the construction module has a substantially straight edge, and the serpentine portion of the modular unit of the construction module has a plurality of substantially straight edges for aligning in 3 directions the construction module with the opposed adjacent construction module.

The modular unit has an opposing second side that is substantially parallel to the side of the modular unit. The second side of the modular unit comprises a reveal portion, the reveal portion extending from the first face toward the second face, the reveal portion being shaped with at least a substantially flat plane along the longitudinal extent of the side of the modular unit for aligning with the reveal portion of the adjacent construction module.

The second side of the modular unit further comprises a serpentine portion, the serpentine portion extending from the second face toward the first face, the serpentine portion being shaped with at least a substantially inclined plane relative to the reveal portion along the longitudinal extent of the side of the modular unit, the serpentine portion being coextensively collocated with at least a section of the reveal portion on the same side of the modular unit, for aligning with the serpentine portion of the adjacent construction module.

The serpentine portion comprises a first projection, the first projection extending from the modular unit in a generally outwardly direction relative to the modular unit, the first projection of the modular unit of the construction module extending substantially the same distance from the reveal portion of the modular unit of the construction module in a generally outwardly direction relative to the modular unit as the recess extending from the reveal portion of the modular unit in a generally inwardly direction relative to the modular unit to eliminate the need for spacing shims, exposed fasteners, and intermediate joint trim.

The modular unit of the construction module defines a complementary shaped projection receiving recess on the second side of the modular unit, the receiving recess extending from the modular unit in a generally inwardly direction relative to the modular unit, the receiving recess being of proper size, shape and orientation to facilitate positioning of and at least substantially filling by the projection of the opposed adjacent construction module extending from the opposed adjacent construction module in a generally outwardly direction relative to the opposed adjacent construction module, the receiving recess and the first projection being disposed adjacent to each other on the same serpentine portion for restricting movement in a first direction.

The reveal portion of the second side of the modular unit is symmetrically disposed to the serpentine portion of the side of the modular unit. The serpentine portion of the second side of the modular unit is symmetrically disposed to the reveal portion of the side of the modular unit for aligning with the opposed adjacent construction module to assemble a course of construction modules.

Also the modular unit has opposing third and fourth sides that are substantially parallel to each other on the modular unit, each of the opposing third and fourth sides of the modular unit comprises a reveal portion, the reveal portion extending from the first face toward the second face, the reveal portion being shaped with at least a substantially flat plane along the longitudinal extent of the side of the modular unit for aligning with the reveal portion of the adjacent construction module.

Each of the opposing third and fourth sides of the modular unit further comprises a serpentine portion, the serpentine portion extending from the second face toward the first face, the serpentine portion being shaped with at least a substantially inclined plane relative to the reveal portion along the longitudinal extent of the side of the modular unit, the serpentine portion being coextensively collocated with at least a section of the reveal portion on the same side of the modular unit, for aligning with the serpentine portion of the adjacent construction module.

The serpentine portion comprises a first projection, the first projection extending from the modular unit in a generally outwardly direction relative to the modular unit, the first projection of the modular unit of the construction module extending substantially the same distance from the reveal portion of the modular unit of the construction module in a generally outwardly direction relative to the modular unit as the recess extending from the reveal portion of the modular unit in a generally inwardly direction relative to the modular unit to eliminate the need for spacing shims, exposed fasteners, and intermediate joint trim.

The modular unit of the construction module defines a complementary shaped projection receiving recess on the second side of the modular unit. The receiving recess extends from the modular unit in a generally inwardly direction relative to the modular unit, the receiving recess being of proper size, shape and orientation to facilitate positioning of and at least substantially filling by the projection of the opposed adjacent construction module extending from the opposed adjacent construction module in a generally outwardly direction relative to the opposed adjacent construction module. The receiving recess and the first projection are disposed adjacent to each other on the same serpentine portion for restricting movement in a first direction.

The reveal portion of the fourth side of the modular unit is symmetrically disposed to the serpentine portion of the third side of the modular unit. The serpentine portion of the fourth side of the modular unit is symmetrically disposed to the reveal portion of the third side of the modular unit for aligning with the opposed adjacent construction module to produce a multiple-course construction surface that deters inter-construction module expansion force buckling.

A preferred embodiment the present invention is illustrated by way of example in FIGS. 1 through 12. With specific reference to FIGS. 1 through 3, a fastening element 20 comprises a reveal edge 24 and a serpentine edge 26.

Figure 2:
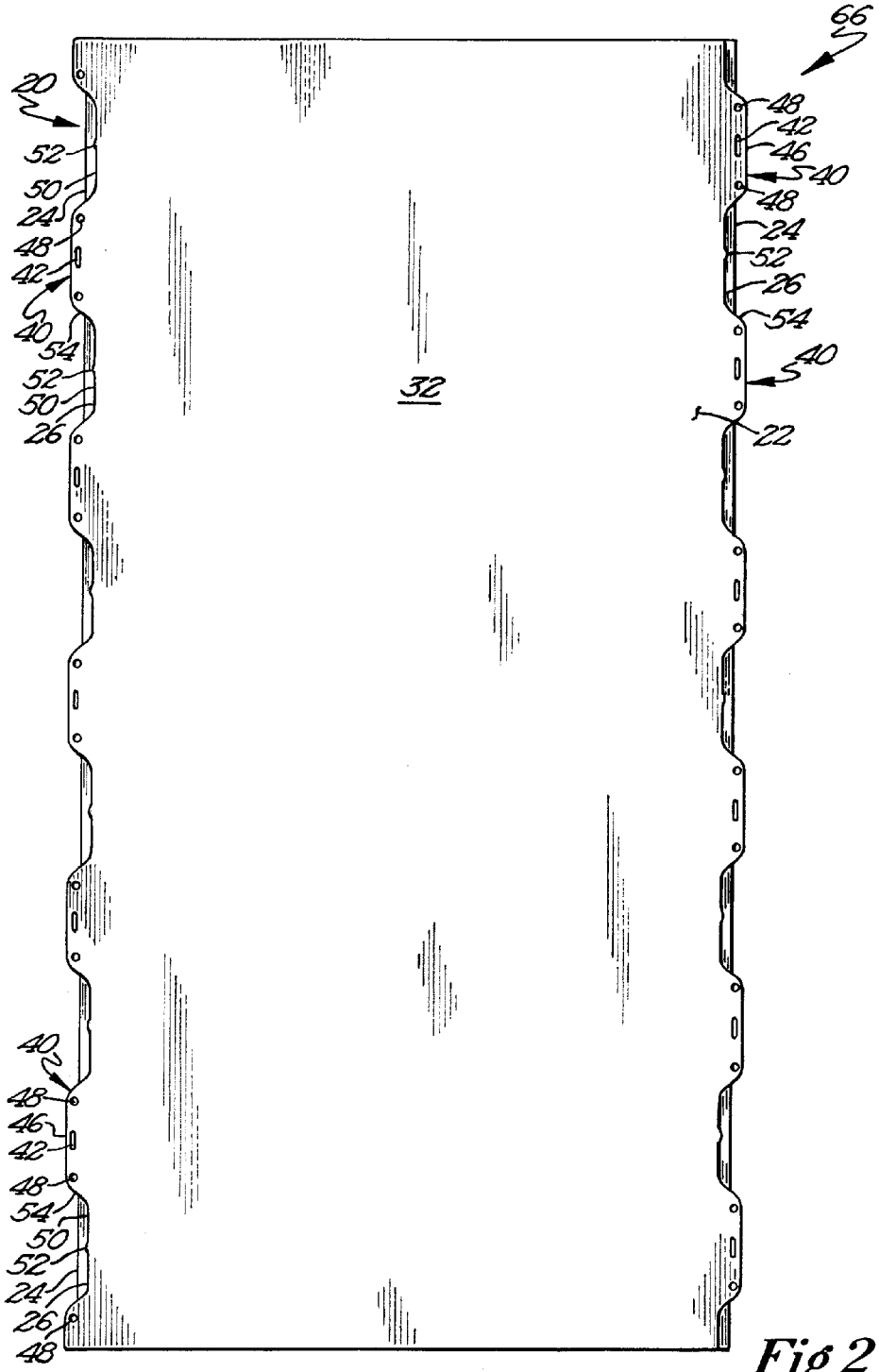
FIG. 2 is a rear elevational view of the panel in FIG. 1.

FIG. 1 is a front view of the fastening element 20 on a panel 66 as it is used to operatively connect panels together into a structure. FIG. 2 depicts a rear view of the panel 66 in FIG. 1.

Figure 3:
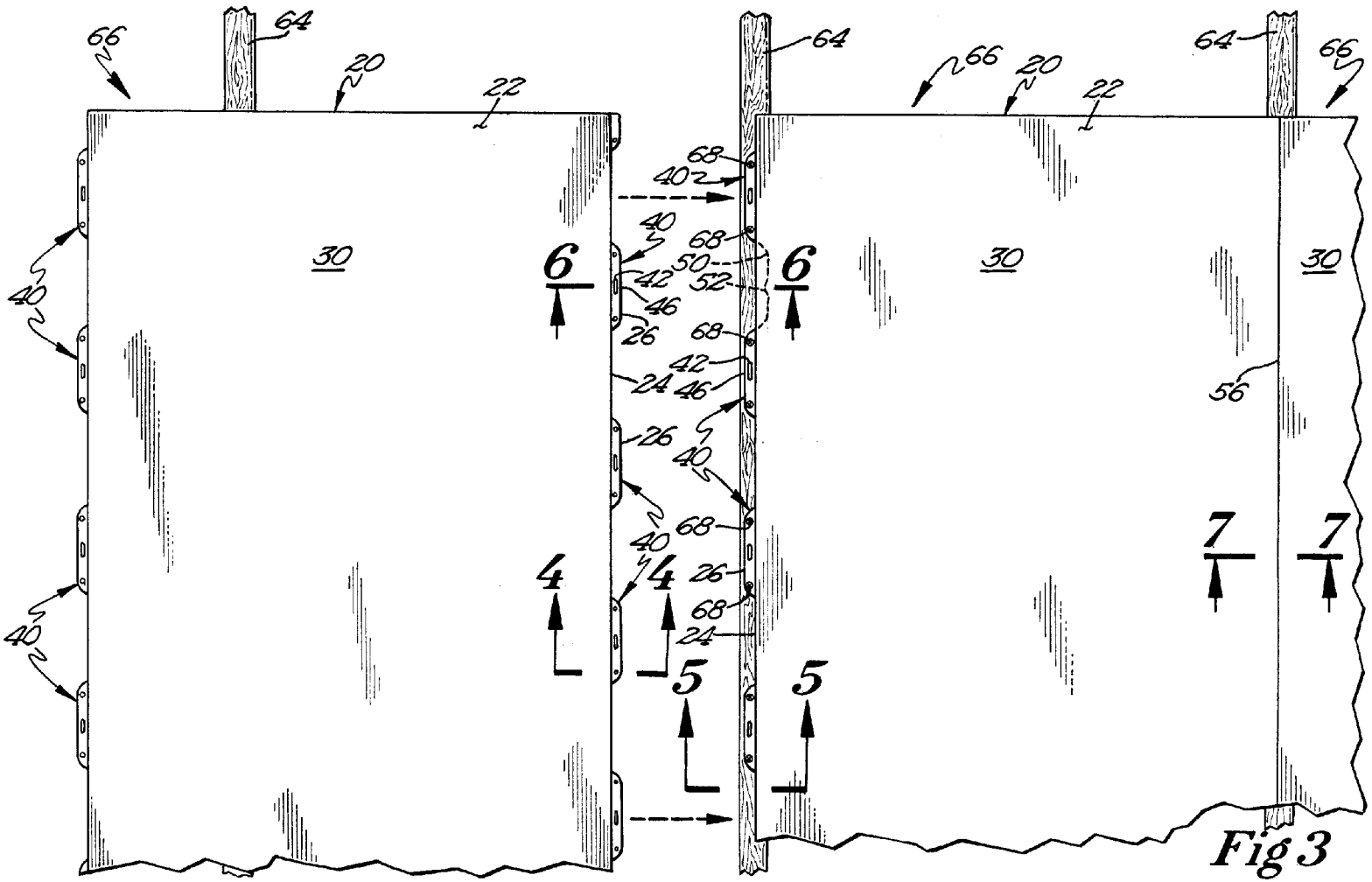
FIG. 3 is a front elevational view of a panel wall under construction with two panels shown mounted on 2×4" studs and a third panel being moved into position to be secured to the wall.

An example of a combination of at least two panels 66 in a conventional environment surrounding or associated with a preferred embodiment of the invention is the construction of a wall structure with panels 66 secured to 2×4" studs 64. FIG. 3 shows a front view of a panel wall under construction with two panels 66 shown mounted on 2×4" studs 64 and a third panel 66 being moved into position to be secured against the wall.

Figure 5:
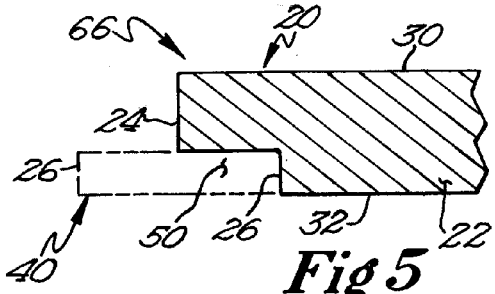
FIG. 5 is a horizontal section of the recess of the panel taken along a line 5-5 of FIG. 3.
Figure 6:
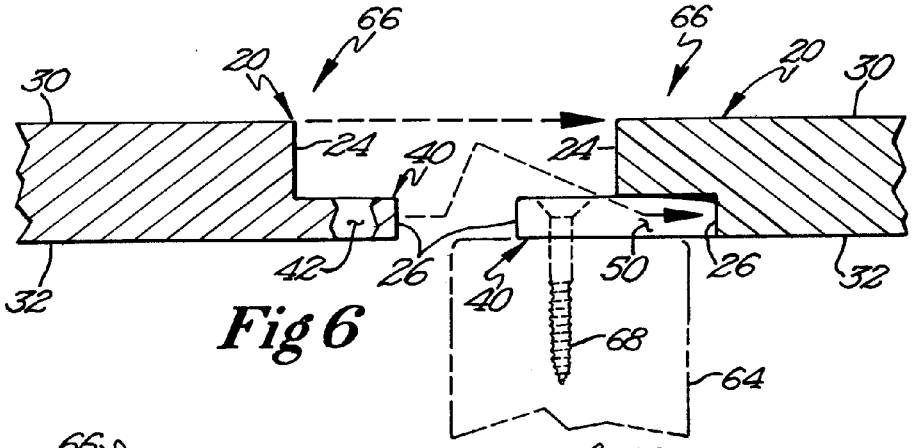
FIG. 6 is a horizontal section of the projection and the recess areas of two panels being assembled taken along line 6-6 of FIG. 3.
Figure 7:
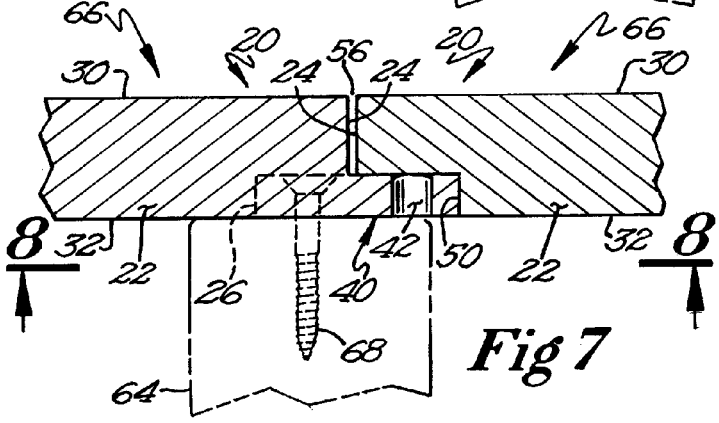
FIG. 7 is a horizontal section of two panels assembled and mounted to a 2×4" stud taken along line 7-7 of FIG. 3.

Reveal edge 24 has a planar shape and is located on the edge of the panel front face 30 of the panel 66 as best seen in FIGS. 4-7. Two adjacent, properly installed wood panels 66 each have a reveal edge 24 close to but not touching each other forming a gap called a reveal expansion 56 as depicted in FIG. 7.

The serpentine edge 26 has an S-shape located on the edge of the panel back face 32 of the panel 66. Overall, in FIG. 2 the serpentine edge 26 is shown to extend the entire length of opposing sides of panel 66. Portions of the serpentine edge 26 are shown in FIGS. 4-7, but are best seen in the enlarged view of FIGS. 8 and 8*a*.

Figure 4:
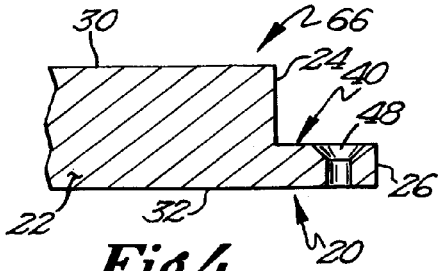
FIG. 4 is a horizontal section of a portion of the projection of the panel taken along a line 4-4 FIG. 3.

The serpentine edge 26 includes a projection 40. FIG. 4 shows a portion of the projection 40 of the fastening element 20 on the panel 66. The projection 40 extends from the fastening element 20 in a generally outwardly direction relative to the fastening element 20.

The projection 40 defines an aperture, such as an expansion relief aperture 42. The aperture 42 is disposed away from the serpentine edge of the projection as illustrated in the enlarged view of FIGS. 8 and 8*a*. The aperture 42 extends in a generally parallel direction relative to the serpentine edge 26 of the projection 40. Also, the aperture is configured for receiving a trim fastener 62 that provides a hidden connection from the projection 40 to trim, such as perimeter trim 60. As example, one such trim fastener 62, suitable for use in a preferred embodiment of the present invention, is disposed in U.S. Pat. No. 6,186,698 which is incorporated herein by reference thereto. "Klick" fastener is manufactured by Friedrich Knapp Gmbh in Austria.

In addition, the serpentine edge 26 includes a recess 50. FIG. 5 is a horizontal section of the recess of the panel 66. The fastening element defines the recess 50. The recess 50 extends from the fastening element 20 in a generally inwardly direction relative to the fastening element 20 and is configured for receiving a second projection 40 from a second fastening element 20. The projection 40 and the recess 50 are disposed adjacent to each other on the same serpentine edge 26 so that adjacent panels 66 can be operatively connected to each other in a structure.

Furthermore, the fastening element 20 defines a bulge such as an expansion bulge 52. As shown in FIGS. 8 and 8*a*, the expansion bulge 52 is disposed upon the serpentine edge 26 of the recess 50, and extends in a generally outwardly direction relative to the fastening element 20. The expansion bulge 52 is configured for transferring an expansion force from the fastening element 20 to aperture 42 of the projection 40 of an adjacent panel 66.

FIG. 6 illustrates a horizontal section of the projection 40 and the recess 50 areas of two panels 66 being assembled. FIG. 7 is a horizontal section of two panels 66 assembled and mounted to 2×4" studs 64.

FIG. 8 shows a rear view of two mounted panels 66 with a 2×4" stud 64 in phantom and showing various mounting details including the serpentine edge expansion 58 and the expansion relief aperture 42 in a relaxed position. FIG. 8*a* depicts the same as FIG. 8 but in a compressed position showing how the invention accommodates dimensional changes in adjacent wood panels 66 from moisture and temperature fluctuations by allowing for expansion both with the elimination of the gap of serpentine edge expansion 58 and with the compression of expansion relief aperture 42 adjacent to expansion bulge 52 in the recess 50 of the adjacent panel 66.

Figure 9:
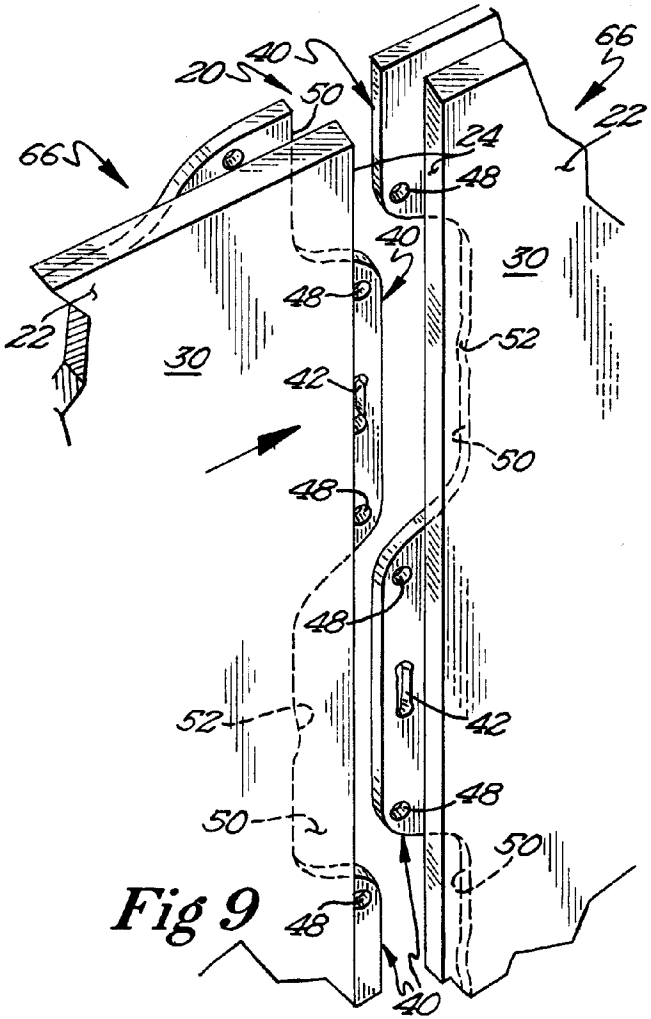
FIG. 9 is a perspective view of a preferred embodiment of the invention showing the panel front face of two adjacent panels each having a configuration on each side shaped for connecting with the mating configuration of an opposed adjacent construction module on a substrate for providing the option of a multiple course installation.

FIG. 9 shows the panel front face 30 of two adjacent panels 66 each having a fastening element 20 on a top side in addition to the other left and right sides of a panel 66 for installing a multiple course structure.

Figure 10:
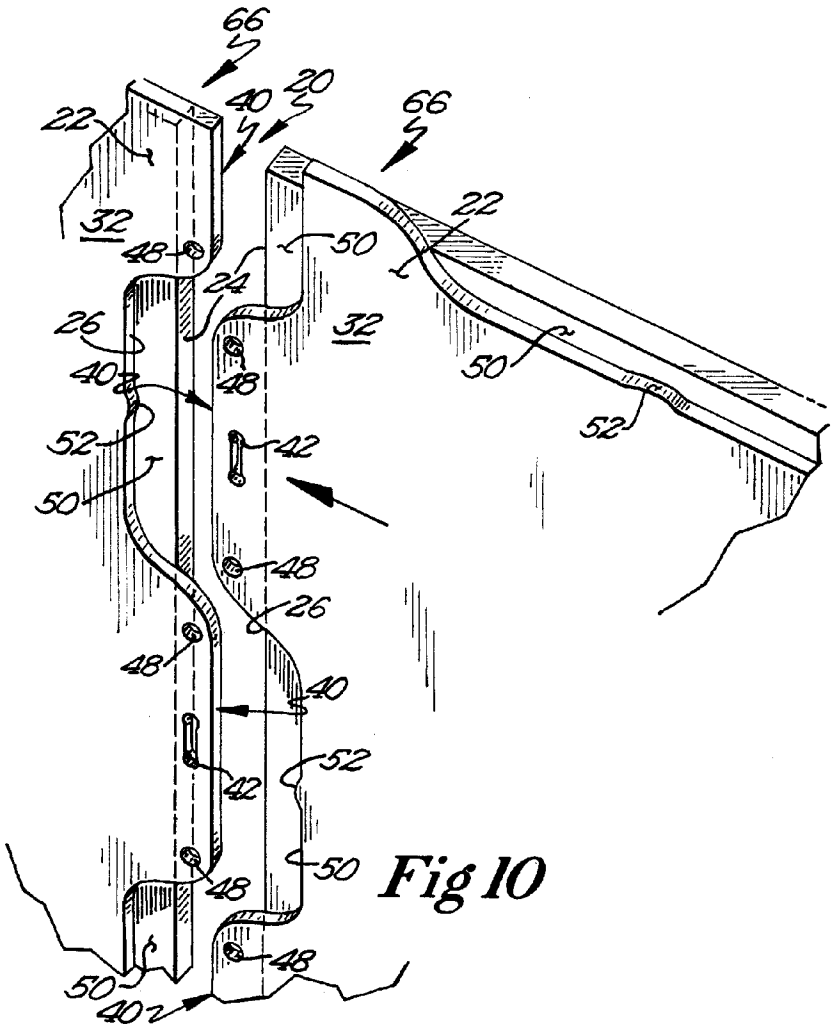
FIG. 10 is a perspective view of a preferred embodiment of the invention showing the panel back face of two adjacent panels each having a configuration on each side shaped for connecting with the mating configuration of an opposed adjacent construction module on a substrate for providing the option of a multiple course installation.

FIG. 10 illustrates the panel back face 32 of the two adjacent panels 66 shown in FIG. 9 with each also having a fastening element 20 on top side in addition to the other opposing sides of a panel 66 designed for multiple course installation.

Figure 12:
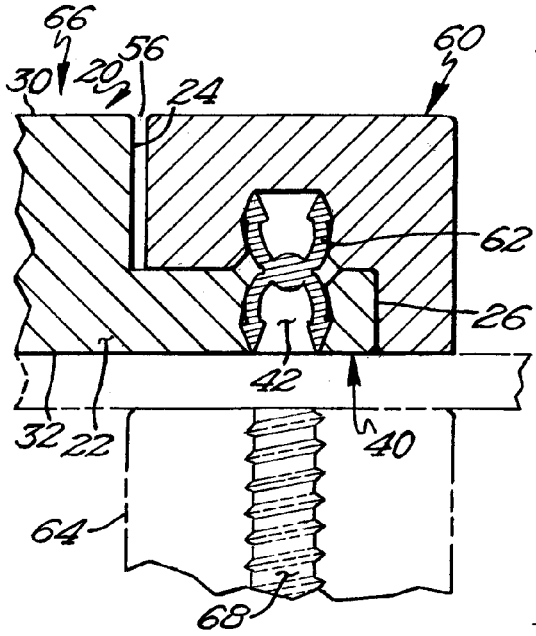
FIG. 12 is a cross-section taken along line 12-12 of FIG. 11 to reveal details with the fastening element installation onto a panel edge with perimeter trim.
Figure 11:
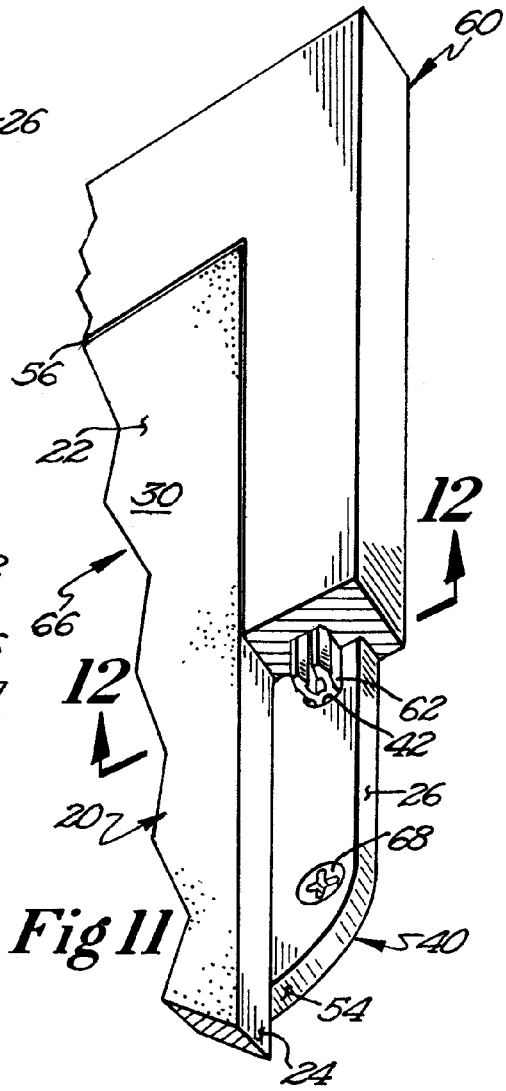
FIG. 11 is a perspective view of another preferred embodiment of the invention showing a fastening element mounting for installing perimeter trim onto to a panel edge.

In FIG. 11, a fastening element 20 mounting is depicted for installing perimeter trim 60 onto a panel 66 edge. FIG. 12 reveals details of the fastening element 20 as used to install onto the panel 66 edge some perimeter trim 60.

In use on a panel 66 to another panel 66 construction, a first panel 66 may be secured to 2×4 studs 64 of a wall with common fasteners 68, such as screws driven through a countersunk screw hole 48 on the projections 40. As shown in FIGS. 3, 9, and 10, a second panel 66 can be joined with the adjacent first panel 66 to create a single course construction. The projections 40 on the right side of the second panel 66 are inserted into the recesses 50 on the left side of the adjacent first panel 66. Then the projections 40 on the opposing left side of the second panel 66 from the adjacent first panel 66 may be secured to 2×4 studs 64 of the wall. The need to similarly secure the right side of the second panel 66 with fasteners 68 into the stud 64 is eliminated because the recesses 50 on the left side of the first panel 66 supports and secures the projections 40 on the right side of the second panel 66.

An embodiment of a fastening element for slidably coupling with a second fastening element including a projection, and for use with a trim fastener, and to transfer an expansion force from the fastening element onto a web that deflects into an aperture defined by the projection of the second fastening element with both the web and the aperture being on the same projection of the serpentine portion of the panel member of the second fastening element, is shown in FIGS. 1-12 as a fastening element 20.

The fastening element 20 comprises a panel member such as body 22 having a side, a first face such as panel front face 30, and a second face such as panel back face 32. The side of the panel member body 22 comprises a reveal portion such as reveal edge 24 disposed toward the first face panel front face 30 of the panel member, and a serpentine portion such as serpentine edge 26 disposed toward the second face panel back face 32 of the panel member body 22.

The serpentine portion includes a first projection of the panel member of the fastening element such as a projection 40. The first projection extends from the panel member in a generally outwardly direction relative to the panel member. The first projection of the panel member of the fastening element extends substantially the same distance from the edge of the reveal portion of the panel member of the fastening element in a generally outwardly direction relative to the panel member as the recess extends from the edge of the reveal portion of the panel member in a generally inwardly direction relative to the panel member.

The first projection of the panel member of the fastening element such as a projection 40 defines an aperture, shown here in the embodiment of expansion relief aperture 42 and is best seen in FIGS. 8*a,* 8*b*, 9, and 10. The aperture is disposed away from the serpentine edge of the first projection, with the aperture extending in a generally parallel direction relative to the serpentine edge of the first projection, and with the aperture configured for receiving the trim fastener.

The same aperture or another aperture may be used for the different function of absorbing expansion force from the same panel or an adjacent panel. The first projection 40 of the panel member of the fastening element 20 defines an aperture, such as shown here in the embodiment of expansion relief aperture 42 and is best seen in FIGS. 8*a,* 8*b*, 9, and 10 which is the same aperture used and configured for receiving the trim fastener 62 discussed above. Here for handling repeated cycles of expansion and contraction, the aperture such as the expansion relief aperture 42 extends in a generally parallel direction relative to the serpentine edge 26 of the first projection 40, with the aperture disposed at a predetermined distance away from the serpentine edge 26 of the first projection 40, and with the aperture configured for dissipating an expansion force from the second fastening element 20.

The panel member of the fastening element, such as body 22, defines a recess, which is shown here in the embodiment of recess 50. The recess 50 extends from the panel member in a generally inwardly direction relative to the panel member, with the recess being of proper size, shape and orientation to facilitate positioning of and the substantially filling by the projection of the second fastening element extending from the second fastening element in a generally outwardly direction relative to the second fastening element.

The panel member of the fastening element, here body 22, defines an expansion bulge that in this illustrated embodiment is identified as expansion bulge 52. The bulge is disposed at the recess of the serpentine portion of the panel member of the fastening element, with the bulge extending in a generally outwardly direction relative to the panel member. The bulge of the fastening element is configured for contacting the web of the projection of the serpentine portion of the panel member of the second fastening element to transfer an expansion force from the bulge of the fastening element onto the web that deflects into the aperture defined by the projection of the second fastening element with both the web and the aperture being on the same projection of the serpentine portion of the panel member of the second fastening element. The expansion bulge of the panel member of the fastening element is hidden as viewed from the front face of the panel member of the fastening element, with the bulge disposed within the recess of the serpentine portion, and with the bulge extending in a generally outwardly direction relative to the panel member.

The first projection, projection 40, and the recess, recess 50, are disposed adjacent to each other on the same serpentine portion for restricting movement in a first direction. A second projection of the panel member of the fastening element, such as another projection 40, is disposed on the serpentine portion and adjacent to the recess portion on the serpentine portion for restricting movement in a second direction.

In one alternative, the fastening element of the claimed invention can also be used for reducing the cost and work of attaching additional panel alignment hardware and for reducing some distance a panel must extend from a support surface caused by panel attachment brackets. The side of the panel member of the fastening element that comprises the reveal portion and the serpentine portion is machined entirely within the thickness of the panel member of the fastening element. The reveal portion of the panel member of the fastening element has a substantially straight edge. The serpentine portion of the panel member of the fastening element has a plurality of substantially curved edges so that when the second fastening element is pushed against the fastening element, the first projection of the panel member of the fastening element and the second projection of the panel member of the fastening element slidably directs the projection of the second fastening element into the recess of the panel member of the fastening element for aligning in 3 directions the fastening element with the second fastening element.

In another alternative, the fastening element of the claimed invention can also be used for reducing the cost and work of attaching additional panel alignment hardware and for reducing some distance a panel must extend from a support surface caused by panel attachment brackets. Again the side of the panel member of the fastening element that comprises the reveal portion and the serpentine portion is machined entirely within the thickness of the panel member of the fastening element, the reveal portion of the panel member of the fastening element has a substantially straight edge; but now instead the serpentine portion of the panel member of the fastening element has a plurality of substantially straight edges for aligning in 3 directions the fastening element with the second fastening element.

In use on a panel 66 to trim 60 construction, the fastening element 20 is configured to receive on each desired side of each panel 66 the desired perimeter trim 60 as shown in FIGS. 9, 10, and 11. A trim fastener 62, such as a Klick fastener may be used as depicted in FIGS. 11 and 12. One portion of the trim fastener 62 is inserted into the expansion relief aperture 42 of a projection 40 located on the exposed perimeter of the panel 66 to be framed. The trim, such as perimeter trim 60 is shown in FIGS. 11 and 12 to be attached to the exposed other portion of the trim fastener 62 which is inserted into the expansion relief aperture 42 of a projection 40 thereby securing and hiding the formerly the exposed perimeter of the panel 66 with trim 60.

While the fastening system for panels and trim of the present invention has been disclosed in the drawings in a particular way with a given number and shape of left and right projections 40 and recesses 50 on a panel 66, it should be appreciated that the fastening system can be used in other environments with different variations within the same invention. For example, projections 40 and recesses 50 could be spaced further apart such as with 4 left and 3 right projections on opposing panel 66 sides. Other variations in size and shape are understood to be included in the invention such as wider projections 40 and rectangular projections 40.

The present invention provides an improved fastening system for panels and trim to guide and to operatively connect panels 66 together and to connect a panel 66 with trim 60. The same fastening element 20 provides multiple use capabilities for reducing manufacturing and labor costs for eliminating a current need to manufacture, purchase, install and adjust additional specialized panel joining hardware or mounting blocks, and for reducing the time spent laying out the installation.

When hanging a panel 66 with another adjacent panel 66, the fastening element 20 guides and connects adjacent panel front faces 30 into a flush horizontal alignment with each other for eliminating the need to purchase, and the labor cost of installing a separate additional element such as a spline, wood biscuit, dowel, or other mechanical alignment hardware. Also, the fastening element 20 vertically aligns adjacent multiple course panels 66 with each other for reducing dependence on the variable skill of an installer and for eliminating the need of additional mechanical gauges and alignment tools along with the skill to use them.

The present invention provides a way to attach panels 66 closer to and lying flatter against a wall presenting a diminished profile for reducing the size of required finishing trim 60. Also the invention provides an attachment method and means that can be augmented with adhesives for reducing the number of required fasteners 68 and for providing temporary clamping.

Even more, the fastening element 20 securely affixes panels 66 with fasteners 68 such as screws that are hidden by adjacent panels 66 for eliminating exposed fasteners along with the need to conceal fasteners 68 with putty or mechanical covers. See FIGS. 4-7.

The fastening element 20 further provides a means of accommodating dimensional changes in fixedly secured adjacent wood panels 66 from moisture and temperature fluctuations for reducing the possibility of installing the wood panels 66 with insufficient or omitted allowance for expansion and buckling that may result in costly panel 66 damage.

As shown in FIG. 8, expansion bulge 52 of recess 50 on a first panel 66 contacts the web 46 of projection 40 of another panel 66 to create the serpentine edge expansion 58 and consequently the reveal expansion 56 as seen in FIG. 7. Together they gauge reveal spacing between adjacent panels 66 for eliminating the need for separate spacing shims or for depending on the variable skills of different installers.

Finally, the present invention provides an improved fastening system to connect a panel 66 to trim 60 with the fastening element 20. Perimeter trim 60 may be applied with a hidden trim fastener 62 facilitated by the expansion relief aperture 42 onto many structurally different panel 66 designs for eliminating the need to affix trim 60 by additional modification of an exposed panel 66 edge.

The invention described above may be embodied in other forms without departing from the spirit or essential characteristics thereof. The embodiments disclosed in this application are to be considered in all respects as illustrative and not restrictive. The scope of the invention is indicated by the appended claims rather than by the foregoing description and all changes which come within the meaning and range of equivalency of the claims are intended to be embraced therein.

What is claimed is:

1. A construction module, comprising:

a modular unit having a side, a first face, and a second face, the modular unit having a configuration on one side shaped for connecting with the mating configuration of an opposed adjacent construction module on a substrate;

the side of the modular unit comprising a reveal portion, the reveal portion of the modular unit defining a recess, the reveal portion extending from the first face toward the second face, the reveal portion being shaped with at least a substantially flat plane along the longitudinal extent of the side of the modular unit for aligning with the reveal portion of the adjacent construction module;

the side of the modular unit further comprising a serpentine portion, the serpentine portion extending from the second face toward the first face, the serpentine portion being shaped with at least a substantially inclined plane relative to the reveal portion along the longitudinal extent of the side of the modular unit, the serpentine portion being coextensively collocated with at least a section of the reveal portion on the same side of the modular unit for aligning with the serpentine portion of the adjacent construction module;

the serpentine portion comprising a projection, the projection extending from the modular unit in a generally outwardly direction relative to the modular unit, the projection of the modular unit of the construction module extending substantially the same distance from the reveal portion of the modular unit of the construction module in a generally outwardly direction relative to the modular unit as the recess extending from the reveal portion of the modular unit in a generally inwardly direction relative to the modular unit; and the projection defining an aperture, with the aperture disposed away from the serpentine portion of the projection, with the aperture extending in a generally parallel direction relative to the serpentine portion of the projection, with the aperture unobstructed by a fastener in use, with the aperture configured for receiving a trim fastener, and with the aperture disposed at a predetermined distance away from the serpentine portion of the projection for dissipating an expansion force from an adjacent module so that when slidably coupling the construction module in a first direction toward mating with the opposed adjacent construction module, if the construction module is misaligned with the opposed adjacent construction module in a second direction, then some of the projection of the serpentine portion of the construction module may be obstructed by some of either the reveal portion or the projection of the serpentine portion of the opposed adjacent construction module and thereby producing a visually obvious gap at the joint to immediately alert the installer for timely correction before securing, but if the construction module is aligned with the adjacent construction module, then all of the projection of the serpentine portion of the construction module will fit with the serpentine portion of the adjacent construction module thereby producing no visually obvious gap at the joint to immediately confirm proper alignment and readiness for securing.

2. The construction module of claim 1, wherein the construction module defines an expansion bulge, with the bulge disposed upon the serpentine portion of the receiving recess, with the bulge extending in a generally outwardly direction relative to the construction module, with the bulge configured for transferring an expansion force from the construction module to aperture of the projection of an adjacent module.

3. The construction module of claim 1, wherein the projection defines an aperture, with the aperture extending in a generally parallel direction relative to the serpentine portion of the projection, with the aperture unobstructed by a fastener in use, and with the aperture disposed at a predetermined distance away from the serpentine portion of the projection for dissipating an expansion force from an adjacent module.

4. The construction module of claim 3, wherein the construction module defines an expansion bulge, with the bulge disposed upon the serpentine portion of the receiving recess, with the bulge extending in a generally outwardly direction relative to the construction module, and with the bulge configured for transferring an expansion force from the construction module to aperture of the projection of an adjacent module.

5. A construction module, comprising:

a modular unit having a side, a first face, and a second face, the modular unit having a configuration on one side shaped for integrally connecting with the mating configuration of an opposed adjacent construction module on a substrate;

the side of the modular unit comprising a reveal portion, the reveal portion extending from the first face toward the second face, the reveal portion being shaped with at least a substantially flat plane along the longitudinal extent of the side of the modular unit for aligning with the reveal portion of the adjacent construction module;

the side of the modular unit further comprising a serpentine portion, the serpentine portion extending from the second face toward the first face, the serpentine portion being shaped with at least a substantially inclined plane relative to the reveal portion along the longitudinal extent of the side of the modular unit, the serpentine portion being coextensively collocated with at least a section of the reveal portion on the same side of the modular unit for aligning with the serpentine portion of the adjacent construction module;

the serpentine portion comprising a first projection, the first projection extending from the modular unit in a generally outwardly direction relative to the modular unit, the first projection of the modular unit of the construction module extending substantially the same distance from the reveal portion of the modular unit of the construction module in a generally outwardly direction relative to the modular unit as a recess extending from the reveal portion of the modular unit in a generally inwardly direction relative to the modular unit to eliminate the need for interposing a spacing device between construction modules;

the modular unit of the construction module defining a complementary shaped projection receiving recess, the receiving recess extending from the modular unit in a generally inwardly direction relative to the modular unit, the receiving recess being of proper size, shape and orientation to facilitate positioning of and at least substantially filling by the projection of the opposed adjacent construction module extending from the opposed adjacent construction module in a generally outwardly direction relative to the opposed adjacent construction module, the receiving recess and the first projection being disposed adjacent to each other on the same serpentine portion for restricting movement in a first direction;

the serpentine portion of the side of the modular unit further comprising a second projection, the second projection extending from the modular unit in a generally outwardly direction relative to the modular unit, the second projection extending substantially the same distance from the reveal portion of the modular unit of the construction module in a generally outwardly direction relative to the modular unit as the recess extending from the reveal portion of the modular unit in a generally inwardly direction relative to the modular unit, the second projection disposed adjacent to the receiving recess, the second projection, the receiving recess, and the first projection disposed on the same serpentine portion for restricting movement in a second direction to transfer an expansion force from the construction module onto a web that deflects into an aperture defined by the projection of the opposed adjacent construction module with both the web and the aperture being on the same projection of the serpentine portion of the modular unit of the opposed adjacent construction module, and so that when slidably coupling the construction module in a first direction toward mating with the adjacent construction module, if the construction module is misaligned with the adjacent construction module in a second direction, then some of the first projection or the second projection of the serpentine portion of the construction module may be obstructed by some of either the reveal portion or the projection of the serpentine portion of the adjacent construction module and thereby producing a visually obvious gap at the joint to immediately alert the installer for timely correction before securing, but if the construction module is aligned with the adjacent construction module, then all of the first and second projections of the serpentine portion of the construction module will fit with the serpentine portion of the adjacent construction module thereby producing no visually obvious gap at the joint to immediately confirm proper alignment and readiness for securing.

6. The construction module of claim 5, wherein the first projection of the modular unit of the construction module defines an aperture, with the aperture extending in a generally parallel direction relative to the serpentine portion of the first projection, with the aperture disposed at a predetermined distance away from the serpentine portion of the first projection, and with the aperture configured for deflecting and rebounding with expansion force changes from the opposed adjacent construction module.

7. The construction module of claim 5, wherein the side of the modular unit of the construction module that comprises the reveal portion and the serpentine portion is machined entirely within the thickness of the modular unit of the construction module and for reducing the cost and work of attaching to the construction module a panel alignment hardware and for reducing some distance a construction module must extend from a support surface caused by the use of a panel attachment bracket.

8. The construction module of claim 5, wherein the reveal portion of the modular unit of the construction module has a substantially straight edge; and the serpentine portion of the modular unit of the construction module has a plurality of substantially curved edges so that when the opposed adjacent construction module is pushed against the construction module, the first projection of the modular unit of the construction module and the opposed adjacent projection of the modular unit of the construction module slidably directs the projection of the opposed adjacent construction module into the receiving recess of the modular unit of the construction module for aligning in 3 directions the construction module with the opposed adjacent construction module.

9. The construction module of claim 5, wherein the reveal portion of the modular unit of the construction module has a substantially straight edge; and the serpentine portion of the modular unit of the construction module has a plurality of substantially straight edges for aligning in 3 directions the construction module with the opposed adjacent construction module.

10. The construction module of claim 5, wherein the modular unit has an opposing second side that is substantially parallel to the side of the modular unit, the second side of the modular unit comprising a reveal portion, the reveal portion extending from the first face toward the second face, the reveal portion being shaped with at least a substantially flat plane along the longitudinal extent of the side of the modular unit for aligning with the reveal portion of the adjacent construction module;

the second side of the modular unit further comprising a serpentine portion, the serpentine portion extending from the second face toward the first face, the serpentine portion being shaped with at least a substantially inclined plane relative to the reveal portion along the longitudinal extent of the side of the modular unit, the serpentine portion being coextensively collocated with at least a section of the reveal portion on the same side of the modular unit, for aligning with the serpentine portion of the adjacent construction module;

the serpentine portion comprising a first projection, the first projection extending from the modular unit in a generally outwardly direction relative to the modular unit, the first projection of the modular unit of the construction module extending substantially the same distance from the reveal portion of the modular unit of the construction module in a generally outwardly direction relative to the modular unit as the recess extending from the reveal portion of the modular unit in a generally inwardly direction relative to the modular unit to eliminate the need for spacing shims, exposed fasteners, and intermediate joint trim;

the modular unit of the construction module defining a complementary shaped projection receiving recess on the second side of the modular unit, the receiving recess extending from the modular unit in a generally inwardly direction relative to the modular unit, the receiving recess being of proper size, shape and orientation to facilitate positioning of and at least substantially filling by the projection of the opposed adjacent construction module extending from the opposed adjacent construction module in a generally outwardly direction relative to the opposed adjacent construction module, the receiving recess and the first projection being disposed adjacent to each other on the same serpentine portion for restricting movement in a first direction;

the reveal portion of the second side of the modular unit is symmetrically disposed to the serpentine portion of the side of the modular unit, and the serpentine portion of the second side of the modular unit is symmetrically disposed to the reveal portion of the side of the modular unit for aligning with the opposed adjacent construction module to assemble a course of construction modules.

11. The construction module of claim 5, wherein the modular unit has opposing third and fourth sides that are substantially parallel to each other on the modular unit, each of the opposing third and fourth sides of the modular unit comprising a reveal portion, the reveal portion extending from the first face toward the second face, the reveal portion being shaped with at least a substantially flat plane along the longitudinal extent of the side of the modular unit for aligning with the reveal portion of the adjacent construction module;

each of the opposing third and fourth sides of the modular unit further comprising a serpentine portion, the serpentine portion extending from the second face toward the first face, the serpentine portion being shaped with at least a substantially inclined plane relative to the reveal portion along the longitudinal extent of the side of the modular unit, the serpentine portion being coextensively collocated with at least a section of the reveal portion on the same side of the modular unit, for aligning with the serpentine portion of the adjacent construction module;

the serpentine portion comprising a first projection, the first projection extending from the modular unit in a generally outwardly direction relative to the modular unit, the first projection of the modular unit of the construction module extending substantially the same distance from the reveal portion of the modular unit of the construction module in a generally outwardly direction relative to the modular unit as the recess extending from the reveal portion of the modular unit in a generally inwardly direction relative to the modular unit to eliminate the need for spacing shims, exposed fasteners, and intermediate joint trim;

the modular unit of the construction module defining a complementary shaped projection receiving recess on the second side of the modular unit, the receiving recess extending from the modular unit in a generally inwardly direction relative to the modular unit, the receiving recess being of proper size, shape and orientation to facilitate positioning of and at least substantially filling by the projection of the opposed adjacent construction module extending from the opposed adjacent construction module in a generally outwardly direction relative to the opposed adjacent construction module, the receiving recess and the first projection being disposed adjacent to each other on the same serpentine portion for restricting movement in a first direction; and the reveal portion of the fourth side of the modular unit is symmetrically disposed to the serpentine portion of the third side of the modular unit, and the serpentine portion of the fourth side of the modular unit is symmetrically disposed to the reveal portion of the third side of the modular unit for aligning with the opposed adjacent construction module to produce a multiple-course construction surface that deters inter-construction module expansion force buckling.

12. A construction module, comprising:

a modular unit having a side, a first face, and a second face, the modular unit having a configuration on one side shaped for connecting with the mating configuration of an opposed adjacent construction module on a substrate;

the side of the modular unit comprising a reveal portion, the reveal portion of the modular unit defining a recess, the reveal portion extending from the first face toward the second face, the reveal portion being shaped with at least a substantially flat plane along the longitudinal extent of the side of the modular unit for aligning with the reveal portion of the adjacent construction module;

the side of the modular unit further comprising a serpentine portion, the serpentine portion extending from the second face toward the first face, the serpentine portion being shaped with at least a substantially inclined plane relative to the reveal portion along the longitudinal extent of the side of the modular unit, the serpentine portion being coextensively collocated with at least a section of the reveal portion on the same side of the modular unit for aligning with the serpentine portion of the adjacent construction module;

the serpentine portion comprising a projection, the projection extending from the modular unit in a generally outwardly direction relative to the modular unit, the projection of the modular unit of the construction module extending substantially the same distance from the reveal portion of the modular unit of the construction module in a generally outwardly direction relative to the modular unit as the recess extending from the reveal portion of the modular unit in a generally inwardly direction relative to the modular unit;

the projection defining an aperture, with the aperture disposed away from the serpentine portion of the projection, with the aperture extending in a generally parallel direction relative to the serpentine portion of the projection, with the aperture configured for receiving a trim fastener, and with the aperture disposed at a predetermined distance away from the serpentine portion of the projection for dissipating an expansion force from an adjacent module so that when slidably coupling the construction module in a first direction toward mating with the opposed adjacent construction module, if the construction module is misaligned with the opposed adjacent construction module in a second direction, then some of the projection of the serpentine portion of the construction module may be obstructed by some of either the reveal portion or the projection of the serpentine portion of the opposed adjacent construction module and thereby producing a visually obvious gap at the joint to immediately alert the installer for timely correction before securing, but if the construction module is aligned with the adjacent construction module, then all of the projection of the serpentine portion of the construction module will fit with the serpentine portion of the adjacent construction module thereby producing no visually obvious gap at the joint to immediately confirm proper alignment and readiness for securing; and the construction module defining an expansion bulge, with the bulge disposed upon the serpentine portion of the receiving recess, with the bulge extending in a generally outwardly direction relative to the construction module, with the bulge configured for transferring an expansion force from the construction module to aperture of the projection of an adjacent module.

13. The construction module of claim 12, wherein the projection defines an aperture, with the aperture extending in a generally parallel direction relative to the serpentine portion of the projection, and with the aperture disposed at a predetermined distance away from the serpentine portion of the projection for dissipating an expansion force from an adjacent module; and the construction module defines an expansion bulge, with the bulge disposed upon the serpentine portion of the receiving recess, with the bulge extending in a generally outwardly direction relative to the construction module, and with the bulge configured for transferring an expansion force from the construction module to aperture of the projection of an adjacent module.

* * * * *